US006684527B1

(12) United States Patent
Wise

(10) Patent No.: US 6,684,527 B1
(45) Date of Patent: Feb. 3, 2004

(54) VENEER DRYER AND METHOD OF DRYING

(76) Inventor: Robert J. Wise, 2140 Greenview St., Eugene, OR (US) 97401

( * ) Notice: Subject to any disclaimer, the term of this patent is extended or adjusted under 35 U.S.C. 154(b) by 0 days.

(21) Appl. No.: 10/310,422

(22) Filed: Dec. 6, 2002

(51) Int. Cl.[7] ..... F26B 7/00

(52) U.S. Cl. ..... 34/418; 34/616; 34/617; 34/202; 34/236; 34/543

(58) Field of Search ..... 34/543, 545, 546, 34/547, 83, 611, 616, 617, 619, 418, 659, 201, 202, 236

(56) References Cited

U.S. PATENT DOCUMENTS 4,106,209 A * 8/1978 Brown ..... 34/9.5
4,193,207 A 3/1980 Allen et al. ..... 34/13.8
4,483,730 A * 11/1984 Honda ..... 156/242
4,827,630 A * 5/1989 Honda et al. ..... 34/146
4,945,652 A * 8/1990 Clarket et al. ..... 34/12
5,012,595 A * 5/1991 Christian et al. ..... 34/187
6,108,942 A * 8/2000 Fezer ..... 34/636

* cited by examiner

*Primary Examiner*—Ira S. Lazarus
*Assistant Examiner*—Camtu Nguyen
(74) *Attorney, Agent, or Firm*—James D. Givnan, Jr.

(57) ABSTRACT

A wheel includes a peripheral outer wall onto which are sequentially loaded veneer panels. The panels are held in place by cable runs against a heated outer surface of the wheel outer wall. Drying of the veneer panels occurs during wheel rotation. A heated fluid medium such as hot oil flows through an annular chamber of the wheel. A series of inlet conduits supply the annular chamber with the heated medium while return conduits return same to a heat source. Multiple tensioned runs of cable confine each panel in place during wheel rotation. A modified form utilizes a continuous screen for panel retention. A drive system imparts rotation to the wheel by powered components in contact with the wheel periphery. A panel pre-heater and jet dryers are supplemental heat sources.

19 Claims, 3 Drawing Sheets

FIG. 3
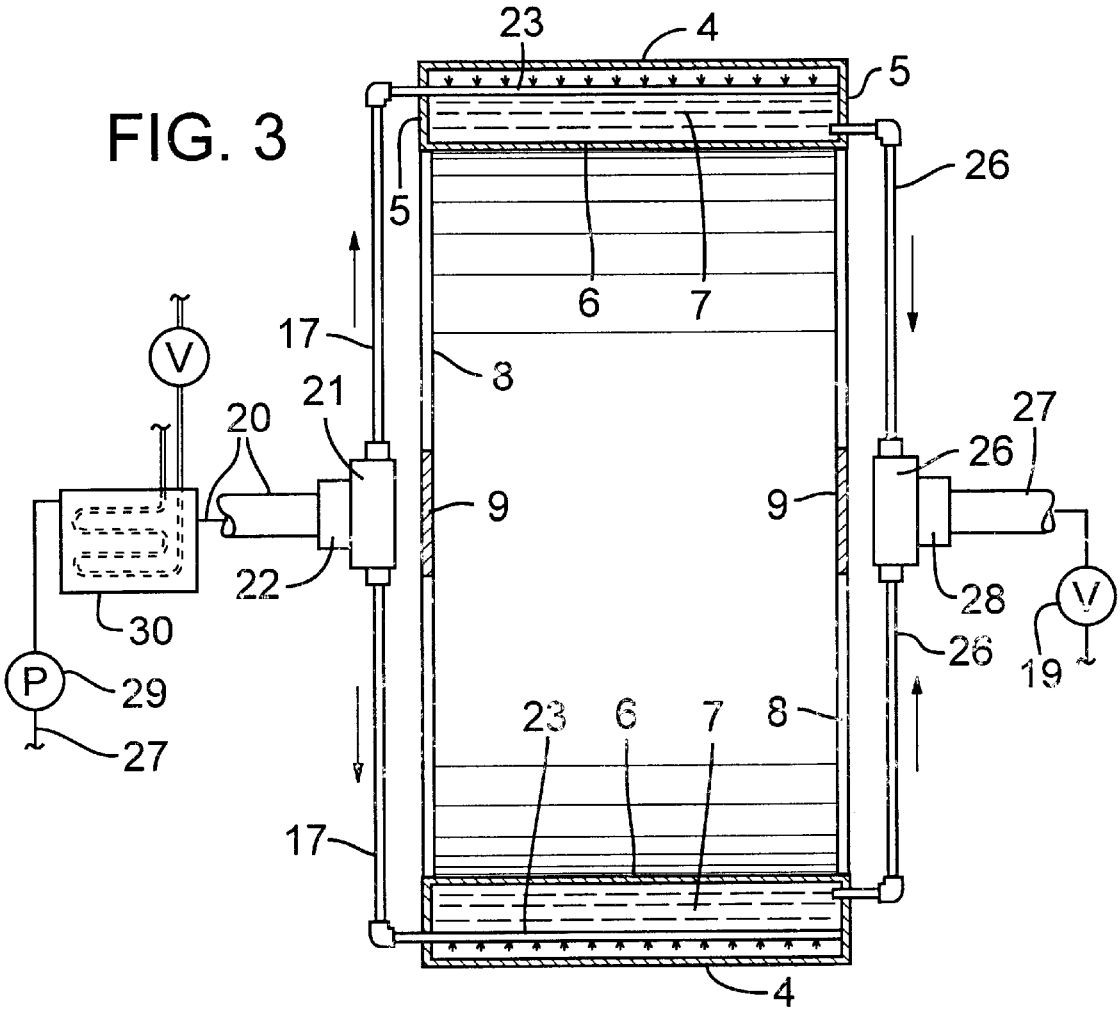
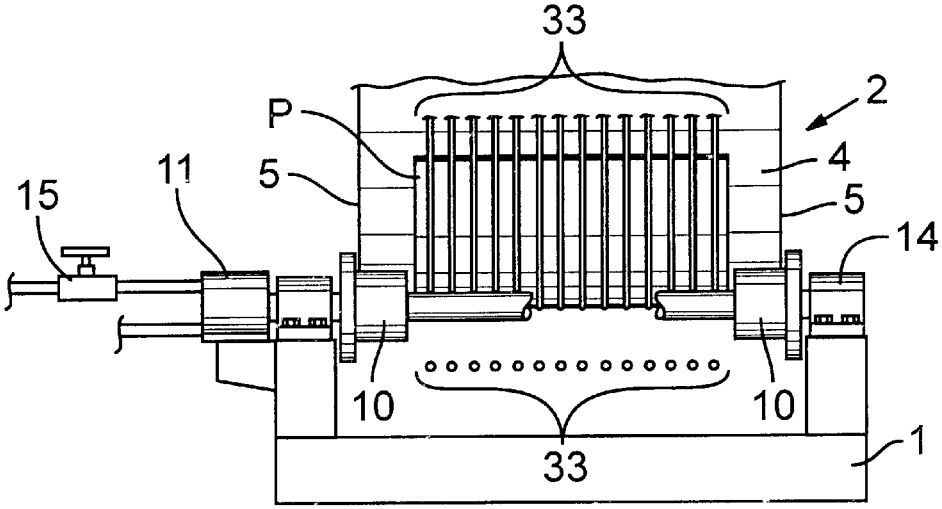
FIG. 4

VENEER DRYER AND METHOD OF DRYING

BACKGROUND OF THE INVENTION

The present invention concerns generally the drying of veneer sheets to a moisture level suitable for subsequent use of the sheets in a manufactured product such as plywood panels.

Typically, wood veneer is cut from a lathe mounted block with the sheet subsequently being clipped or cut and then dried to a desired moisture content. Typically the panels or sheets are dried by passage through a dryer on a conveyor wherein hot air flows impinge on both sides of the veneer resulting in heating and partial drying of same. Considerable effort must be directed toward the drying of veneer to prevent over-drying which results in a defective manufactured product such as plywood. Conversely, under drying of veneer can also result in a defective finished product. Still further, excessive shrinkage of a panel may result in an over-dried veneer panel. Veneer panels still having excessive moisture content after passage through a dryer must be subjected to a second drying operation at a considerable reduction in the efficiency of a dryer operation. Fires in veneer dryers are not unknown and result from the veneer being heated to the point of combustion and result in costly damage to the dryer and of course the loss of veneer sheets therein. Dryer fires are costly also from the standpoint of down time of a veneer plant for purposes of dryer repair.

Incorporated herein by reference is U.S. Pat. No. 4,193,207 and specifically columns 1, 2, 3 and lines 1–52 of column 4.

U.S. Pat. No. 4,193,207 discloses a veneer dryer having a rotatable frame on which are mounted a circular array of hot presses. The frame is indexed to sequentially locate the hot presses at an on-loading station and an off-loading station. The presses each include a series of grooved heated plates which close toward one another with a veneer panel between each of the plates for contact drying of several panels during closure of the hot press plates. The heated plates dry the veneer by heat transfer and, upon indexing of the dryer frame, each hot press is positioned for off-loading of the sheets or panels upon opening of the press. Drawbacks to the dryer disclosed in the above noted patent include complexity and hence a high capital cost and the modification of plant facilities for installation of same. The utilization of the several hot presses on a frame each with a multitude of heated plates each served by a flexible steam lines would incur high maintenance costs as would the pair of hydraulic cylinders for closing each hot press.

Important objectives of the present veneer dryer include reduced substantially electricity consumption and increasing thermal efficiency in the contact heating of veneer panels; the avoidance of plug ups occurring in existing veneer dryers resulting from the divergence of a panel from the desired path through a dryer; the avoidance of fire resulting in costly damage to and down time of a conventional dryer; the reduction of hydrocarbon particles emitted from dryers; the avoidance of periodically cleaning of a conventional veneer dryer to remove wood fragments and deposits; the provision of a dryer with reduced maintenance costs than that incurred with conventional veneer dryers.

SUMMARY OF THE PRESENT INVENTION

The present invention is embodied within an apparatus for reducing the moisture content of veneer panels by contact with a heated surface of a wheel member.

The present dryer includes a wheel having a heated continuous surface for the reception of veneer sheets or panels. An annular or circular chamber of the wheel receives a heated medium. Provision is made for circulating the medium through the chamber. Retention of the panels on the wheel outer surface includes, in one form of the invention, multiple runs of cable directed in overlying fashion on the veneer. Retention of panels may be achieved otherwise, as for example, such as by a continuous screen. A drive system imparts rotation to the wheel at a speed to achieve the desired duration of panel heating and moisture reduction. The cable runs, or other panel retention components, may be initially utilized to carry the panels, in sequence, into wheel contact at an on-loading site of the apparatus. Pre-heating of such panels, if necessary, is achieved by a pre-heater at the on-loading site. Provision is made for controlling the speed of wheel rotation while additional control means enables the temperature of the heated medium to be varied to accomplish the specific drying tasks. A method of reducing the moisture content in wood veneer panels also constitutes part of the present invention.

BRIEF DESCRIPTION OF THE DRAWINGS

In the accompanying drawings:

FIG. 3 is a vertical sectional view taken along 3—3 of FIG. 2;

FIG. 4 is a vertical sectional view taken along line 4—4 of FIG. 1;

DETAILED DESCRIPTION OF THE PREFERRED EMBODIMENT

Figure 1:
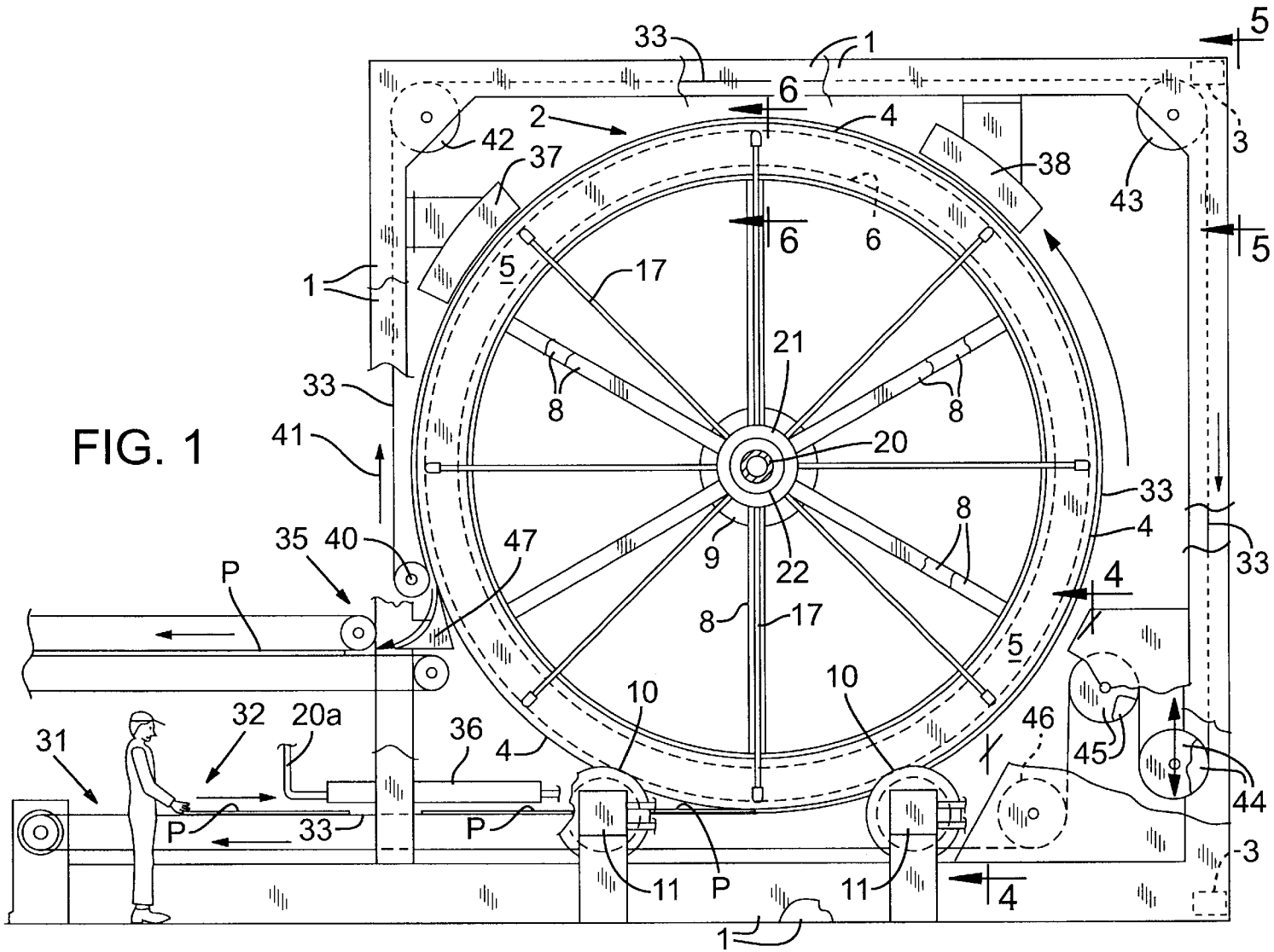
FIG. 1 is a side elevational view of the present dryer.
Figure 2:
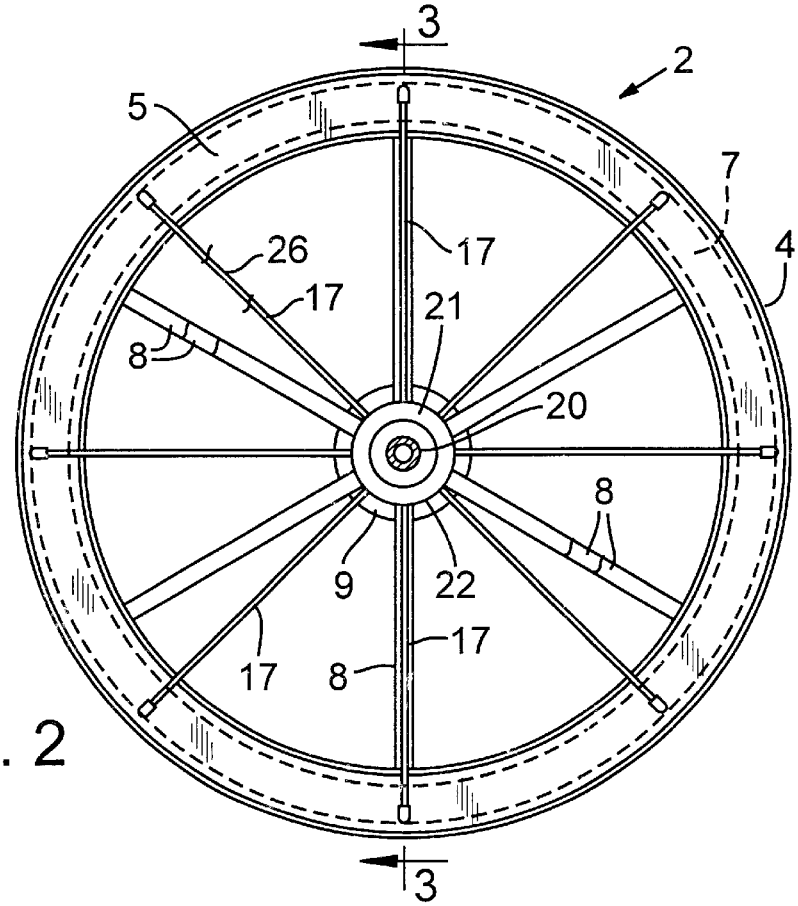
FIG. 2 is a side elevational view of the dryer wheel removed from the dryer.

With continuing attention to the drawings wherein reference numerals indicate parts similarly hereinafter identified, a framework of the present dryer includes upright frame members 1 oppositely spaced from a dryer wheel indicated generally at 2. Cross members as at 3 join the upright frame members to support the following described components in unitary fashion. The frame members may be of welded tubular steel.

With attention to wheel 2, the same is of several feet in diameter, for example, 18–20 feet, having an outer or peripheral wall at 4. Wheel side walls at 5 are of plate configuration terminating outwardly in securement to wheel peripheral wall 4. An inner wall member 6 of the wheel is radially inset from wall 4 and welded to wheel side plates 5 to define an annular chamber at 7. Annular chamber 7 is formed for the reception of a heated medium, as for example hot oil, for heating exterior wall 4 of the wheel. Spokes 8 are joined by wheel hub plates 9.

A drive system for wheel 2 is illustrated in FIGS. 1 and 4 and includes paired drive wheels at 10 each pair powered by a motor at 11 which may be hydraulic in fluid circuit with a speed control at 15. Each drive, in addition to pairs of wheels 10, includes a powered shaft 13 journaled in bearings 14. The drive wheels 10 are in driving contact with wheel 2 adjacent the wheel edges. Speed control 15 permits an operator, or other speed control, to determine wheel speed to accomplish the veneer drying task at hand. While a hydraulic drive system is mentioned, it will be understood that various types of drives may be utilized to achieve rotation of wheel 2 in regulated fashion. Veneers with different drying requirements are dried in a suitable manner as a function of wheel speed and the temperature of a heated medium later described. Further, in some dryer installations it may be desirable to provide an axle for wheel 2 permitting driving of wheel 2 by means of a sprocket and chain arrangement. Other drive systems may be feasible without departing from the scope of the present invention.

A heated medium such as oil, as noted earlier, is provided to annular chamber 7 to heat peripheral wall 4 of the wheel. An array of supply conduits at 17 are in upstream communication with a'supply conduit 20 via a manifold at 21. A fluid tight coupling at 22 permits rotation of manifold 21. The conduits 17 each serve a discharge pipe 23 within annular chamber 7 resulting in charging chamber 7 and heating wheel wall 4 on which several veneer panels are carried. Chamber 7 is in downstream communication with a manifold 25 via return conduits 26 (FIG. 3) to permit discharge of the medium through a fluid tight coupling 28 for return along a return line 27 to a heated supply tank 30 by a pump 29. Conduits 17 and 25 components providing delivery of and return of the heated medium to annular chamber 7 are suitably insulated as are the chamber components to minimize heat loss. A valve at 19 regulates the return flow of oil.

The drying of veneer panels at P is initiated upon placement on peripheral wall 4 of the wheel. As shown in FIG. 1, the panels are initially placed on multiple runs of steel cables 33 which runs serve as a conveyor generally at 31 at an on-loading station 32. Conveyor 31 delivers each veneer panel to wall 4 with the panel passing intermediate drive wheels 10 as shown in FIG. 4. The panels are preferably orientated with their tight side on wall 4. Continuous wheel rotation results in multiple cable biased contact of each successive veneer panel with wall 4. An off-loading site indicated generally at 35. The several continuous cables 33 are uniformly laterally spaced a few inches from one another to urge the panels into biased contact with wheel wall 4.

If necessary, a pre-heater at 36 serves to initially heat each panel P and may utilize the heated medium delivered by a branch conduit 20A from supply conduit 20.

Supplemental drying of the veneer, panels is provided by jet dryers-37,and 38 on framework 1 to deliver heated airflows to the cable retained panels. The heated airflows impinge on the loose side of the veneer panels as the tight side, as earlier noted is in abutment with wheel surface 4. A panel diverter at 47 directs the panels from the wheel to an off-loading conveyor at 48 to constitute an outfeed.

Figure 7:
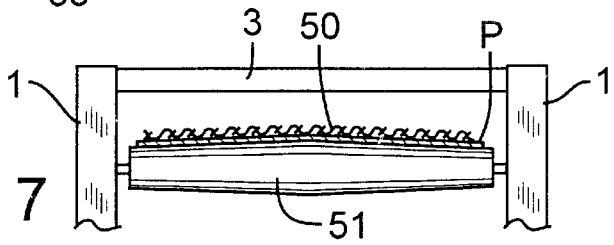
FIG. 7 is a view similar to FIG. 5 but showing a panel retaining screen used in a modified form of the dryer.

In FIG. 7, a modified panel retention means utilizes a continuous screen 50 to overlie the veneer panels during drying. A double tapered roll is at 51 and is typical of those rolls supported by the machine framework on which the screen is entrained.

Figure 5:
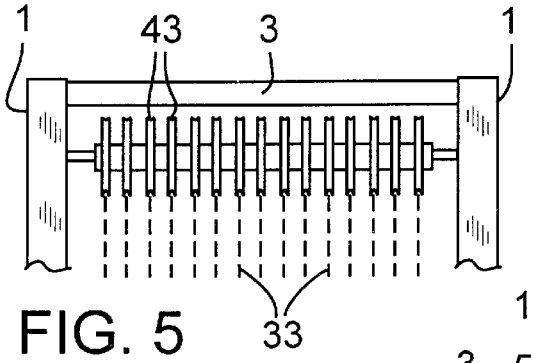
FIG. 5 is a view taken along line 5—5 of FIG. 1 showing multiple cable support structure.
Figure 6:
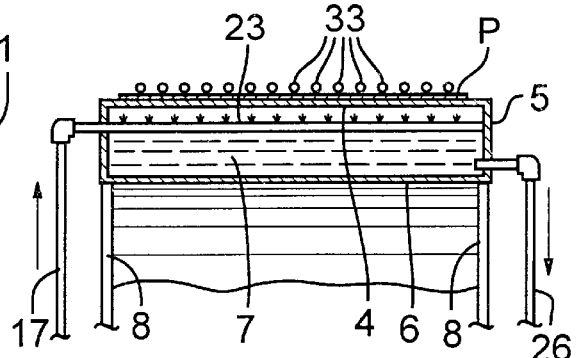
FIG. 6 is a vertical sectional view taken along line 6—6 of FIG. 1 showing a partial cross-section of the wheel.

With attention again to off-loading site 35, cable retention of the panel terminates upon reversal of the cables about a cable idler 40 whereupon cables 33 are directed per arrow 41 past cable idlers 42 and 43 typically shown in FIG. 5, as including a series of pulleys. A cable tensioning mechanism includes a set of weight biased pulleys 44. Additional cable idlers are at 45 and 46.

It is anticipated peripheral wall 4 will be heated to a temperature between 300 degrees F. to 480 degrees F. with drying time determined by veneer moisture content, the specie of wood and veneer thickness to achieve 0% to 20% moisture content.

While I have shown but a few embodiments of the invention, it will be apparent to those skilled in the art that the invention may be embodied still otherwise without departing from the spirit and scope of the claimed invention.

Having thus described the invention, what is desired to be secured by a Letters Patent is:

I claim:

1. A dryer for veneer panels comprising, a framework, a wheel having a heated peripheral wall on which veneer panels are placed, supported by said framework, and panel retention means extending substantially about the periphery of said wheel for retentive contact with veneer panels on the wheel;

fluid conduit means including a receptacle partially defined by the peripheral wall wherein a heated fluid imparts heat to the peripheral wall of the wheel, a drive system imparting rotation to said wheel in a continuous manner, an on-loading station whereat veneer panels are inserted intermediate the peripheral wall of the wheel and said panel retention means, and an off-loading station whereat veneer panels are discharged from the wheel.

2. A method of reducing moisture content in a wood veneer panel consisting in the steps of:

presenting a wood veneer panel to a peripheral wall member of a wheel, imparting rotation to the wheel, retention of the wood veneer panel in place on the peripheral wall member of the wheel by at least one continuous flexible member entrained about the wheel, directing a heated medium into contact with the peripheral wall member of the wheel for contact heating of the veneer panel, and terminating retention of the wood veneer panel on the heated peripheral wall member at an off-loading site.

3. The method claimed in claim 2 including the preliminary step of preheating the panel prior to wheel contact.

4. The method claimed in claim 2 including the additional step subsequent to entraining of a panel on the wheel peripheral surface of directing a heated airflow onto the outwardly disposed surface of the veneer panel.

5. The method claimed in claim 2 additionally including the step of regulating wheel speed for determining the duration of contact of a veneer panel with the peripheral member of the wheel.

6. The dryer claimed in claim 1 wherein said heated peripheral surface is a continuous wall.

7. The dryer claimed in claim 1 wherein said panel retention means is embodied in multiple continuous cables.

8. The dryer claimed in claim 1 wherein said panel retention means is embodied in a continuous screen.

9. The dryer claimed in claim 1 wherein said panel retention means is embodied in multiple cables having parallel runs, at least some of said runs constituting a conveyor for transferring veneer panels onto said peripheral wall of the wheel.

10. The dryer claimed in claim 1 additionally including a pre-heater offset from said wheel and sequentially heating the veneer panels prior to wheel contact.

11. The dryer claimed in claim 1 wherein said drive means includes a drive member and a motor in driving engagement with the drive member.

12. The dryer claimed in claim 11 wherein said motor is of the variable speed type.

13. The dryer claimed in claim 12 wherein said drive means includes pairs of drive members additionally serving to support said wheel.

14. The dryer claimed in claim 1 additionally including jet dryers adjacent the peripheral surface of said wheel.

15. The dryer claimed in claim 1 wherein said fluid conduit means includes multiple supply conduits and multiple return conduits in communication with said receptacle.

16. The dryer claimed in claim 15 wherein said receptacle is an annual chamber.

17. The drying machine for wood veneer panels and comprising, a wheel shaped structure having a peripheral wall, a chamber defined by the peripheral wall, conduits in communication with the chamber and with a heat source, a drive system imparting rotation to said wheel structure, continuous means extending about a major portion of the peripheral wall for retention of wood veneer panels in place on the peripheral wall, and on and off loading stations adjacent the wheel structure for installation on said removal of wheel structure peripheral wall.

18. The drying machine claimed in claim 17 wherein said continuous means include runs of cable entrained about the wheel structure.

19. The machine claimed in claim 17 wherein said continuous means includes a ribbon of screen entrained about the wheel structure.

* * * * *